US012458086B2

(12) United States Patent
Kettner et al.

(10) Patent No.: US 12,458,086 B2
(45) Date of Patent: Nov. 4, 2025

(54) GLOVE AS WELL AS WEARABLE DEVICE

(71) Applicant: Workaround GmbH, Munich (DE)

(72) Inventors: Michael Kettner, Munich (DE); Simon Armbruster, Munich (DE)

(73) Assignee: WORKAROUND GMBH, Munich (DE)

( * ) Notice: Subject to any disclaimer, the term of this patent is extended or adjusted under 35 U.S.C. 154(b) by 105 days.

(21) Appl. No.: 18/500,382

(22) Filed: Nov. 2, 2023

(65) Prior Publication Data

US 2024/0180273 A1 Jun. 6, 2024

(30) Foreign Application Priority Data

Dec. 2, 2022 (DE) ..... 10 2022 132 061.8

(51) Int. Cl.
*A41D 19/00* (2006.01)
*A41D 19/015* (2006.01)

(52) U.S. Cl.
CPC ..... *A41D 19/0024* (2013.01); *A41D 19/0006* (2013.01); *A41D 19/015* (2013.01)

(58) Field of Classification Search
CPC ..... A41D 19/0024; A41D 19/0027; A41D 19/0006; A41D 19/015; A41D 19/0003; A41D 19/0013; A41D 19/00; A41D 19/001; A41D 19/01576; A41D 19/01594; A41D 19/0037; A41D 1/002; A41D 1/005; A41D 13/08; A41D 13/081; A41D 13/088; A41D 13/084; A41D 31/02; A41D 31/18;

(Continued)

(56) References Cited

U.S. PATENT DOCUMENTS 1,165,970 A 12/1915 Harris
1,173,269 A 2/1916 Heidemann
(Continued)

FOREIGN PATENT DOCUMENTS

AT 521938 A3 12/2021
AT 521938 B1 12/2021
(Continued)

OTHER PUBLICATIONS

Borghetti M. et al., "Sensorized Glove for Measuring Hand Finger Flexion for Rehabilitation Purposes," IEEE Transactions on Instrumentation and Measurement, vol. 62, No. 12, Dec. 2013.

(Continued)

*Primary Examiner* — Amy Vanatta
(74) *Attorney, Agent, or Firm* — DILWORTH IP, LLC

(57) ABSTRACT

A glove, in particular a work glove, including at least a base body, a trigger, a first component and a signal line, wherein the first component is attached to the base body, wherein the signal line connects the first component to the trigger electrically and includes a flexible printed circuit board, wherein the base body includes at least a base layer and a cover, wherein the cover covers at least the trigger, wherein the trigger is located between the cover and the base layer, and wherein at least a protective layer is provided in the region of the signal line, the protective layer being attached to the base layer and made of a material that is less stretchable than the material of the cover and the material of the base layer. Moreover, a wearable device is shown.

16 Claims, 2 Drawing Sheets

(58) Field of Classification Search
CPC ..... A41D 31/24; A41D 2400/44; G06K 7/10396; G06K 7/10891; G06K 2007/10534; G06K 19/07762; G06K 7/10; G06F 3/014
See application file for complete search history.

(56) References Cited

U.S. PATENT DOCUMENTS 1,267,436 A 5/1918 William
2,172,167 A 9/1939 Leventhal
3,512,776 A 5/1970 Thomas, Sr.
3,700,836 A 10/1972 Rackson
3,790,168 A 2/1974 Hashimoto
4,504,980 A 3/1985 Butcher
4,575,075 A 3/1986 Tarbox
4,652,141 A * 3/1987 Arai ..... A41D 19/0027 968/447
4,658,441 A 4/1987 Smith
4,766,299 A 8/1988 Tierney
5,133,233 A 7/1992 Erwin
5,191,197 A 3/1993 Metlitsky
5,212,372 A 5/1993 Quick
5,255,167 A 10/1993 Toussaint
5,319,185 A 6/1994 Obata
5,329,106 A 7/1994 Hone
5,340,972 A 8/1994 Sandor
5,365,213 A 11/1994 Paull
5,396,053 A 3/1995 Swartz
5,397,296 A 3/1995 Sydor
5,406,649 A 4/1995 Bolembach
5,459,883 A 10/1995 Garceau-Verbeck
5,514,861 A 5/1996 Swartz
5,550,366 A 8/1996 Roustaei
5,580,154 A 12/1996 Coulter
5,592,694 A 1/1997 Yewer, Jr.
5,610,387 A 3/1997 Bard
5,625,180 A 4/1997 Hanson
5,640,712 A 6/1997 Hansen
5,654,534 A 8/1997 Coleman
5,787,896 A 8/1998 Sackett
5,898,161 A 4/1999 DeVita
5,924,136 A 7/1999 Ogean
6,154,199 A 11/2000 Butler
6,232,960 B1 5/2001 Goldman
6,234,393 B1 5/2001 Paratore
6,341,376 B1 1/2002 Smerdon, Jr.
6,505,776 B1 1/2003 Wilz, Sr.
6,853,293 B2 2/2005 Swartz
6,991,364 B2 1/2006 Yang
7,307,242 B1 12/2007 Chen
7,480,944 B2 1/2009 Nascimento
7,504,949 B1 3/2009 Rouaix
7,837,112 B2 11/2010 An
7,959,314 B1 6/2011 Rodriguez
8,038,310 B1 10/2011 Hale
8,230,522 B1 7/2012 Bell
8,235,294 B2 8/2012 Miller
8,376,759 B2 2/2013 Debock
8,449,541 B2 5/2013 Schneider
8,523,377 B1 9/2013 York
8,540,389 B2 9/2013 Tang
8,562,165 B2 10/2013 Thompson
9,082,293 B2 7/2015 Wellman
9,104,271 B1 * 8/2015 Adams ..... G06F 3/0233
9,235,742 B1 1/2016 Qaddoura
9,301,562 B1 4/2016 Chen
9,785,877 B1 10/2017 Fink
9,842,288 B1 12/2017 Debates
9,895,106 B1 2/2018 Graybill
9,900,061 B1 2/2018 Lui
10,064,276 B2 8/2018 Williams
10,135,213 B2 11/2018 Brunnbauer
10,353,466 B1 * 7/2019 Keller ..... A63F 13/5255
10,537,143 B2 1/2020 Guenther
10,695,262 B2 * 6/2020 Brown ..... A61F 13/00051
10,789,436 B1 9/2020 Lim
10,817,689 B2 10/2020 Mazzone
10,996,754 B2 5/2021 Bosworth
D922,063 S 6/2021 Kirchner
11,044,898 B2 6/2021 Deeb
11,059,076 B2 7/2021 Bauer
11,093,725 B2 8/2021 Mistkawi
11,121,515 B2 9/2021 Chahine
11,182,575 B2 11/2021 Sakamoto
D943,585 S 2/2022 Engineer
D944,814 S 3/2022 Huber
D945,423 S 3/2022 Lim
11,326,960 B2 5/2022 Larsen
11,361,391 B2 6/2022 Ottnad
D960,162 S 8/2022 Lim
D964,376 S 9/2022 Sittig
11,464,450 B2 10/2022 Huang
11,470,895 B2 10/2022 Guenther
11,508,018 B2 11/2022 Yoshimoto
11,520,314 B2 12/2022 Schwarz
11,558,909 B2 1/2023 Hutter
11,589,625 B2 2/2023 Oner
D986,253 S 5/2023 Kettner
11,759,288 B2 9/2023 Lenzenhuber
11,792,555 B2 10/2023 Nöllgen
11,899,838 B2 2/2024 Hogbin
11,913,145 B2 2/2024 Laukamp
11,914,771 B2 2/2024 Kirchner
11,954,556 B1 4/2024 Fracassi
2002/0080031 A1 6/2002 Mann
2002/0163495 A1 11/2002 Doynov
2002/0194668 A1 12/2002 Kwon
2003/0006962 A1 1/2003 Bajramovic
2003/0011469 A1 1/2003 Bush
2003/0026170 A1 2/2003 Yang
2004/0025227 A1 2/2004 Jaeger
2004/0128736 A1 7/2004 Raz
2005/0052412 A1 3/2005 McRae
2006/0033710 A1 2/2006 Bajramovic
2006/0044112 A1 3/2006 Bridgelall
2006/0108425 A1 5/2006 Wiklof
2007/0083968 A1 4/2007 Stokes
2007/0083979 A1 4/2007 Daniels
2007/0146127 A1 6/2007 Stilp
2007/0245454 A1 10/2007 Eklund
2007/0288104 A1 12/2007 Yamauchi
2008/0054062 A1 3/2008 Gunning
2008/0071429 A1 3/2008 Kraimer
2008/0136778 A1 6/2008 Hursh
2008/0262666 A1 10/2008 Manning
2009/0056107 A1 3/2009 Williams
2009/0057289 A1 3/2009 Williams
2009/0057290 A1 3/2009 Williams
2009/0121026 A1 5/2009 Druker
2009/0156309 A1 6/2009 Weston
2009/0179739 A1 7/2009 Kim
2009/0247299 A1 10/2009 Conticello
2010/0023314 A1 1/2010 Hernandez-Rebollar
2010/0090949 A1 4/2010 Tianqiao
2010/0097195 A1 4/2010 Majoros
2010/0156783 A1 6/2010 Bajramovic
2010/0234182 A1 9/2010 Hoffman
2011/0016609 A1 1/2011 Phelps
2011/0078842 A1 4/2011 Tang
2011/0122601 A1 5/2011 Waters
2011/0296576 A1 12/2011 Mitchell
2012/0025945 A1 2/2012 Yazadi
2012/0157263 A1 6/2012 Sivak
2012/0187192 A1 7/2012 Lee
2012/0223143 A1 9/2012 Turbovich
2013/0087544 A1 4/2013 Kremer
2013/0197720 A1 8/2013 Kraimer
2013/0258644 A1 10/2013 Comunale
2014/0096306 A1 4/2014 Hill
2014/0125577 A1 5/2014 Hoang
2014/0132410 A1 5/2014 Chang
2014/0172134 A1 6/2014 Meschter
2014/0194166 A1 7/2014 Falck
2014/0214631 A1 7/2014 Hansen

(56) References Cited

U.S. PATENT DOCUMENTS

| | | | |
|---|---|---|---|
| 2014/0215686 | A1 | 8/2014 | McMakin, Jr. |
| 2014/0249944 | A1 | 9/2014 | Hicks |
| 2014/0282923 | A1 | 9/2014 | Narayan |
| 2014/0366249 | A1 | 12/2014 | West |
| 2015/0040880 | A1 | 2/2015 | Tseng |
| 2015/0070162 | A1 | 3/2015 | Vorhies |
| 2015/0130698 | A1 | 5/2015 | Burgess |
| 2015/0150321 | A1 | 6/2015 | Vorhies |
| 2015/0257733 | A1 | 9/2015 | Corbett, III |
| 2015/0286976 | A1 | 10/2015 | Hirschfeld |
| 2015/0314195 | A1 | 11/2015 | Bekri |
| 2015/0375042 | A1 | 12/2015 | Schaffer |
| 2016/0016065 | A1 | 1/2016 | Tan |
| 2016/0018901 | A1 | 1/2016 | Woolley |
| 2016/0033238 | A1 | 2/2016 | Cooper |
| 2016/0054798 | A1 | 2/2016 | Messingher et al. |
| 2016/0066636 | A1 | 3/2016 | West |
| 2016/0068214 | A1 | 3/2016 | Tang |
| 2016/0128406 | A1 | 5/2016 | Shiue |
| 2016/0161301 | A1 | 6/2016 | Guenther |
| 2016/0174897 | A1 | 6/2016 | Sherman |
| 2016/0284236 | A1 | 9/2016 | Bavunoglu |
| 2017/0068276 | A1 | 3/2017 | Wagman |
| 2017/0119553 | A1 | 5/2017 | Cipriani |
| 2017/0168565 | A1 | 6/2017 | Cohen |
| 2017/0215497 | A1 | 8/2017 | Frederick |
| 2017/0265561 | A1 | 9/2017 | Beers |
| 2017/0296098 | A9 | 10/2017 | Ban |
| 2017/0338610 | A1 | 11/2017 | Brunnbauer |
| 2018/0027344 | A1 | 1/2018 | Dzarnoski, Jr. |
| 2018/0146720 | A1 | 5/2018 | Sittig |
| 2018/0213758 | A1 | 8/2018 | Deeb |
| 2018/0295908 | A1 | 10/2018 | Hollo |
| 2018/0326592 | A1 | 11/2018 | Kogan |
| 2018/0376043 | A1 | 12/2018 | Schannath |
| 2019/0197273 | A1 | 6/2019 | Mazzone |
| 2019/0209086 | A1 | 7/2019 | Huang |
| 2019/0213363 | A1 | 7/2019 | Sugiura |
| 2019/0216144 | A1 | 7/2019 | York |
| 2019/0364996 | A1 | 12/2019 | Kettner |
| 2020/0022433 | A1 | 1/2020 | Lu |
| 2020/0134275 | A1 | 4/2020 | Sakamoto |
| 2020/0160016 | A1 | 5/2020 | Sakamoto |
| 2020/0237032 | A1 | 7/2020 | Berlips |
| 2020/0245939 | A1 | 8/2020 | Sittig |
| 2020/0305522 | A1 | 10/2020 | Ruhland |
| 2020/0359721 | A1 | 11/2020 | Meroe |
| 2020/0404993 | A1 | 12/2020 | Phillips |
| 2021/0033472 | A1 | 2/2021 | Turner |
| 2021/0219639 | A1 | 7/2021 | Kettner |
| 2021/0262127 | A1 | 8/2021 | Laukamp |
| 2021/0307433 | A1 | 10/2021 | Hollo |
| 2021/0386132 | A1 | 12/2021 | Goldberg-Poch |
| 2022/0053854 | A1 | 2/2022 | Oner |
| 2022/0100895 | A1 | 3/2022 | Kirchner |
| 2022/0159355 | A1 | 5/2022 | Nöllgen |
| 2023/0112442 | A1 | 4/2023 | Kettner |
| 2023/0115522 | A1 | 4/2023 | Hutter |
| 2024/0111363 | A1* | 4/2024 | Cha ..... G06F 3/017 |
| 2024/0164459 | A1 | 5/2024 | Clark |
| 2024/0237767 | A1 | 7/2024 | Kettner |
| 2025/0061603 | A1* | 2/2025 | Fukui ..... G06T 7/73 |

FOREIGN PATENT DOCUMENTS

| | | | | |
|---|---|---|---|---|
| CN | 2109745 | | 7/1992 | |
| CN | 204217957 | U | 3/2015 | |
| CN | 107616787 | A | 1/2018 | |
| CN | 108272443 | A | 7/2018 | |
| CN | 109891340 | A | 6/2019 | |
| CN | 109891342 | A | 6/2019 | |
| CN | 110327049 | A | 10/2019 | |
| CN | 110647847 | A | 1/2020 | |
| CN | 112218387 | A | 1/2021 | |
| CN | 112294538 | A | 2/2021 | |
| CN | 306506527 | S | 5/2021 | |
| CN | 113144571 | A | 7/2021 | |
| CN | 110327049 | B | 11/2021 | |
| CN | 109891340 | B | 7/2022 | |
| CN | 116114948 | A * | 5/2023 | ..... A41D 19/0027 |
| DE | 202005003216 | | 5/2005 | |
| DE | 202013105192 | | 12/2013 | |
| DE | 102014117164 | | 1/2016 | |
| DE | 202015107112 | | 1/2016 | |
| DE | 102015111506 | A1 | 4/2016 | |
| DE | 102015113847 | | 4/2016 | |
| DE | 102015214331 | | 2/2017 | |
| DE | 102015122281 | | 6/2017 | |
| DE | 102015224308 | | 6/2017 | |
| DE | 10 2016 109 113 | A1 | 11/2017 | |
| DE | 102016109117 | | 11/2017 | |
| DE | 102017107357 | A1 | 4/2018 | |
| DE | 10 2016 123 093 | A1 | 5/2018 | |
| DE | 202017102714 | U1 | 8/2018 | |
| DE | 102017203495 | | 9/2018 | |
| DE | 102018202207 | A1 | 8/2019 | |
| DE | 102018105578 | A1 | 9/2019 | |
| DE | 102018203035 | A1 | 9/2019 | |
| DE | 10 2018 112 945 | A1 | 12/2019 | |
| DE | 102018105578 | B4 | 6/2020 | |
| DE | 102019102685 | A1 | 8/2020 | |
| DE | 102019102730 | A1 | 8/2020 | |
| DE | 102019113964 | A1 | 11/2020 | |
| DE | 102019118887 | A1 | 1/2021 | |
| DE | 102019118969 | A1 | 1/2021 | |
| DE | 102019131235 | A1 | 5/2021 | |
| DE | 10 2020 100 985 | A1 | 7/2021 | |
| DE | 102020106369 | A1 | 9/2021 | |
| DE | 102020122573 | A1 | 3/2022 | |
| DE | 102020125554 | A1 | 3/2022 | |
| DE | 102021200888 | A1 | 8/2022 | |
| DE | 102019131235 | B4 | 9/2022 | |
| DE | 102021122485 | A1 | 3/2023 | |
| DE | 102021134380 | A1 | 6/2023 | |
| DE | 102022132061 | A1 | 6/2024 | |
| DE | 102023000106 | B3 | 6/2024 | |
| EP | 0613762 | | 9/1994 | |
| EP | 1894481 | A1 | 3/2008 | |
| EP | 2578096 | A1 | 4/2013 | |
| EP | 2693689 | | 2/2014 | |
| EP | 3069623 | | 9/2016 | |
| EP | 3208687 | | 8/2017 | |
| EP | 3381839 | A1 | 10/2018 | |
| EP | 3644217 | A1 | 4/2020 | |
| EP | 3654229 | A1 | 5/2020 | |
| EP | 3381839 | B1 | 1/2022 | |
| EP | 4012599 | A1 | 6/2022 | |
| EP | 3529675 | B1 | 12/2022 | |
| EP | 4374727 | A1 | 5/2024 | |
| GB | 2386667 | A | 9/2003 | |
| GB | 2386677 | | 9/2003 | |
| GB | 2422527 | | 8/2006 | |
| GB | 2441295 | | 3/2008 | |
| GB | 2567214 | A | 4/2019 | |
| IT | 201700092386 | A1 | 2/2019 | |
| IT | 202000002125 | A1 | 8/2021 | |
| JP | 2001084329 | A | 3/2001 | |
| JP | 2011094246 | | 5/2011 | |
| JP | 2020503582 | A | 1/2020 | |
| JP | 7105766 | B2 | 7/2022 | |
| KR | 20100024593 | A | 3/2010 | |
| KR | 20110115497 | A | 10/2011 | |
| KR | 20210127051 | A | 10/2021 | |
| RU | 210103 | U1 | 3/2022 | |
| TW | M484318 | | 8/2014 | |
| WO | 9318675 | | 9/1993 | |
| WO | 9850839 | | 11/1998 | |
| WO | 02088918 | | 11/2002 | |
| WO | 03005176 | | 1/2003 | |
| WO | 2006077572 | | 7/2006 | |
| WO | 2008075859 | | 6/2008 | |
| WO | 2012036775 | | 3/2012 | |
| WO | 2014011196 | | 1/2014 | |
| WO | 2016012480 | | 1/2016 | |

(56) References Cited

FOREIGN PATENT DOCUMENTS

| | | | | |
|---|---|---|---|---|
| WO | 2017062621 | | 4/2017 | |
| WO | 2018073420 | A1 | 4/2018 | |
| WO | 2018076067 | A1 | 5/2018 | |
| WO | 2018099430 | A1 | 6/2018 | |
| WO | 2019018702 | A1 | 1/2019 | |
| WO | 2020117166 | A3 | 7/2020 | |
| WO | WO-2020159057 | A1 * | 8/2020 | ..... G06F 3/014 |
| WO | 2021014179 | A3 | 4/2021 | |
| WO | 2021099138 | A1 | 5/2021 | |
| WO | 2021101402 | A1 | 5/2021 | |
| WO | 2021156709 | A1 | 8/2021 | |
| WO | 2022035820 | A1 | 2/2022 | |
| WO | 2023019535 | A1 | 2/2023 | |
| WO | 2024023009 | A1 | 2/2024 | |

OTHER PUBLICATIONS

Dipietro L. et al., "A Survey of Glove-Based Systems and Their Applications," IEEE Transactions on Systems, Man, and Cybernetics—Part C: Applications and Reviews, vol. 38, No. 4, Jul. 2008.

Kim, J-H. et al., 3-D Hand Motion Tracking and Gesture Recognition Using a Data Glove, IEEE International Symposium on Industrial Electronics (ISIE 2009), Seoul Olympic Parktel, Seoul, Korea, Jul. 5-8, 2009.

King, R. C. et al., "Development of a Wireless Sensor Glove for Surgical Skills Assessment," IEEEE Transactions on Information Technology in Biomedicine, vol. 13, No. 5, Sep. 2009.

Simone, L. K. et al., "A low cost instrumented glove for extended monitoring and functional hand assessment," Journal of Neuroscience Methods 160 (2007) 335-348.

Sturman, D.J. et al., "A Survey of Glove-based Input," IEEE Computer Graphics & Applications (1994) 33-39.

Ziegler, J. et al., "Advanced Interaction Metaphors for RFID-Tagged Physical Artefacts," 2011 IEEE International Conference on RFID—Technologies and Applications, 73-80.

Albert Schweitzer: "Rigid-Flex, Flex and Semi-Flex Leiterplatten Technologie", Mar. 17, 2017, https://www.flowcad.ch/cms/upload/downloads/PCBRoadshow20IFlex.pdf (89 pages).

* cited by examiner

GLOVE AS WELL AS WEARABLE DEVICE

FIELD OF THE INVENTION

The invention relates to a glove, in particular a work glove, as well as a wearable device comprising a glove and an electronic module.

BACKGROUND

Gloves comprising electrical triggers are known and are used, for example, in combination with one or more electronic modules. These electronic modules typically have sensors and can also be attached to the glove, resulting in a wearable device, what is termed a "wearable".

For example, the electronic module is a barcode scanner and the trigger triggers a scanning process. The trigger can also be used for other purposes, such as counting processes or operating further units of the wearable. Therefore, the electrical trigger must be simple to trigger, but also protected from being triggered accidentally.

The electrical trigger is connected electrically to the electronic module or a holder for this by means of a signal line. However, work gloves are subject to high stresses, such as stretching of the glove, that can result in the signal line being subject to high stress.

For example, if the glove is pulled in the region of the trigger when taking off the glove, the distance between the trigger and the electronic module and the holder increases. In this way or also as a result of other movements, the signal line is subject to tensile forces. This can result in breakages in the signal line or the connection between the signal line and the trigger can be destroyed.

It is thus the object of the invention to provide a glove in which the service life of the signal line as well as the connection between the trigger and the signal line is extended.

SUMMARY OF THE INVENTION

The object is solved by a glove, in particular a work glove, comprising at least a base body, a trigger, a first component and a signal line. The first component is attached to the base body and the signal line connects the first component to the trigger electrically and has a flexible printed circuit board. The base body comprises at least a base layer and a cover, wherein the cover covers at least the trigger. The trigger is located between the cover and the base layer. A protective layer is provided at least in the region of the signal line, said protective layer being attached to the base layer and made of a material that is less stretchable than both the material of the cover and the material of the base layer.

As a result of the protective layer, the signal line is protected in a targeted manner as the less stretchable material absorbs the tensile forces that the signal line would have been subject to typically. Moreover, an increase in the distance between the first component and the trigger is no longer possible. The protective layer is thus protected from large stresses, thereby improving the service life.

The region of the signal line corresponds, for example, to the region that overlaps with the signal line in the top view of glove, thus is located directly above or below the signal line.

For simpler assembly, the protective layer can extend between the base layer on the one side and the signal line, the first component and/or the trigger on the other side.

In an embodiment, the protective layer extends along the entire length of the signal line, in particular including the trigger, thereby further extending the service life of the signal line and/or the connection to the trigger.

In an aspect, the protective layer is attached to the base layer, in particular by means of sewing, fusing and/or adhesion, by means of which the protective layer absorbs tensile forces reliably. For example, the attachment occurs by means of fusing the entire surface.

Even the signal line can be attached to the base layer, in particular by means of fusing and/or adhesion, thereby positioning the signal line exactly.

To protect the signal line and the trigger further, the cover can be attached to the base layer, in particular by means of sewing.

For example, the base layer, the protective layer and the cover are sown together with the same seam.

In an embodiment, the first component comprises a holder for an electronic module and/or an electronic module, thereby enabling the electronic module to be worn on the hand simply.

For example, the electronic module is a code reader, in particular an optical code reader.

In an embodiment, the protective layer is made of a non-stretchable material, in particular nylon, thereby ensuring that the protective layer absorbs nearly all tensile forces.

For example, the base layer is made of a stretchable material, in particular neoprene, imitation leather, synthetic leather, microfibre material, mesh material and/or spacer fabrics, and/or the cover is made of a stretchable material, in particular a plastic material. In this way, a high degree of wearing comfort with high durability is achieved.

In an aspect, the cover extends from the trigger towards the first component and the signal line is located between the cover and the base layer, thereby protecting the signal line particularly well.

For example, the cover has a receiving space for the trigger formed in it and/or connects to the first component.

The base body can comprise a dorsal section, on which the first component is located, and/or a trigger section, on which the trigger is located, in order to position the trigger and the first component so that the user is disturbed less.

For example, the trigger section is provided on the thumb-side edge of the dorsal section and/or the trigger rests in the worn state of the glove on the radial side of the metacarpophalangeal joint of the index finger of a user's hand, thereby enabling a particularly ergonomic actuation of the trigger by means of the thumb.

In an embodiment, the glove has an attachment section designed to attach the base body to a user's hand in order to fix the first component in position on the user's hand reliably.

For example, the attachment section is a palm section, in particular that is made of the same material as the base layer and/or is designed as a single piece with the base layer, thereby making the glove easy to put on.

It is also conceivable that the attachment section is a strap section, in particular extending from the trigger section and is attached detachably to the base body, in particular a dorsal section of the base body. In this way, the same glove can be worn by people with different sized hands.

Moreover, the object is solved by a wearable device comprising a glove as described previously and an electronic module that is inserted into a holder of the first component, in particular wherein the electronic module comprises a camera, a code reader, for example for optical codes or RFID tags, and/or a display for displaying instructions to the user that are triggerable by actuating the trigger.

The features and advantages described for the glove equally apply to the wearable sensor device and vice versa.

BRIEF DESCRIPTION OF THE DRAWINGS

Additional advantages and features can be found in the following description as well as in the attached drawings to which reference is made. In the drawings.

DETAILED DESCRIPTION

Figure 1:
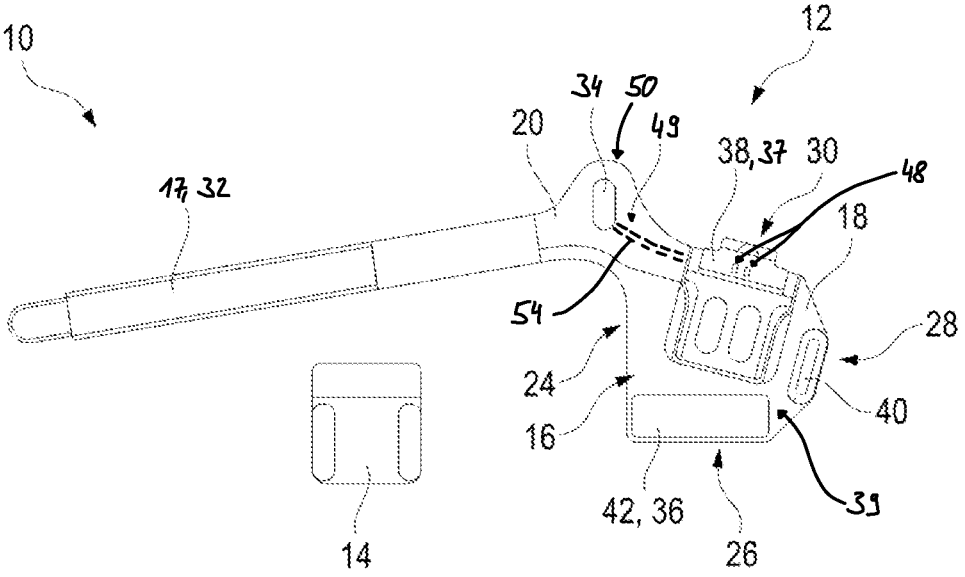
FIG. 1 shows a wearable device according to a first embodiment of the invention comprising a glove according to a first embodiment of the invention in top view in a position spread out on a flat surface.

In FIG. 1, a wearable device 10, in particular a sensor device, is shown comprising a glove 12 and an electronic module 14.

The electronic module 14 is, for example, a compact and robust device for industrial applications. In particular, the electronic module 14 comprises a camera, a code reader and/or a display for displaying instructions to the user.

The code reader can be designed, for example, to scan optical codes, such as barcodes or 2D codes, or to scan RFID tags.

In particular, the electronic module 14 is not a smart device, such as a smartphone.

The glove 12 is shown in FIG. 1 in a state stretched out on a flat surface, for example it is spread out on a table.

The glove 12 has a base body 16, an attachment section 17, by means of which the base body 16 can be attached to the user's hand, a trigger 34 and a first component 37.

The base body comprises a base layer 18, a cover 20 and a protective layer 22.

The base body 16 and, in particular, the entire glove 12 do not have fingers or appendages for fingers.

In the first embodiment shown, the glove 12 and the base body 16 also do not have a palm section, i.e. a section that rests on the palm of the hand in the correctly worn state and covers the majority of the palm, in particular more than 50%.

The glove 12 of the shown embodiment is thus not a full glove with fingers, but rather a glove which only covers the dorsum of a user's hand, provided it is being worn correctly. The glove 12 is thus similar to a bandage that only surrounds parts of the hand and does not need to be pulled over the hand, but rather is closed around the hand.

The base layer 18 is made of, for example, an elastic material, such as neoprene, imitation leather, synthetic leather, microfibre material, mesh material and/or spacer fabrics.

The base layer 18 comprises a thumb-side edge 24, a wrist-side edge 26, a side-of-the-hand edge 28 as well as a finger-side edge 30. The edges 24, 26, 28, 30 are located in this order counterclockwise.

The specifications "thumb-side", "wrist-side", "side-of the-hand" and "finger-side" relate to the position of the corresponding edge 24, 26, 28, 30 in relation to the user's hand in the correctly worn state of the glove 12.

For simplification, reference is made in the context of this disclosure to a top side and an underside of the glove 12, or rather the base body 16 and its sections. The top side is the visible side in FIG. 1 while the underside is the hidden side.

The thumb-side edge 24 and the side-of-the-hand edge 28 are opposite to each other. Similarly, the wrist-side edge 26 and the finger-side edge 30 are opposite one another.

In the shown embodiment, the attachment section 17 is designed as strap section 32 that extends from the base body 16 on its thumb-side edge 24.

Figure 2:
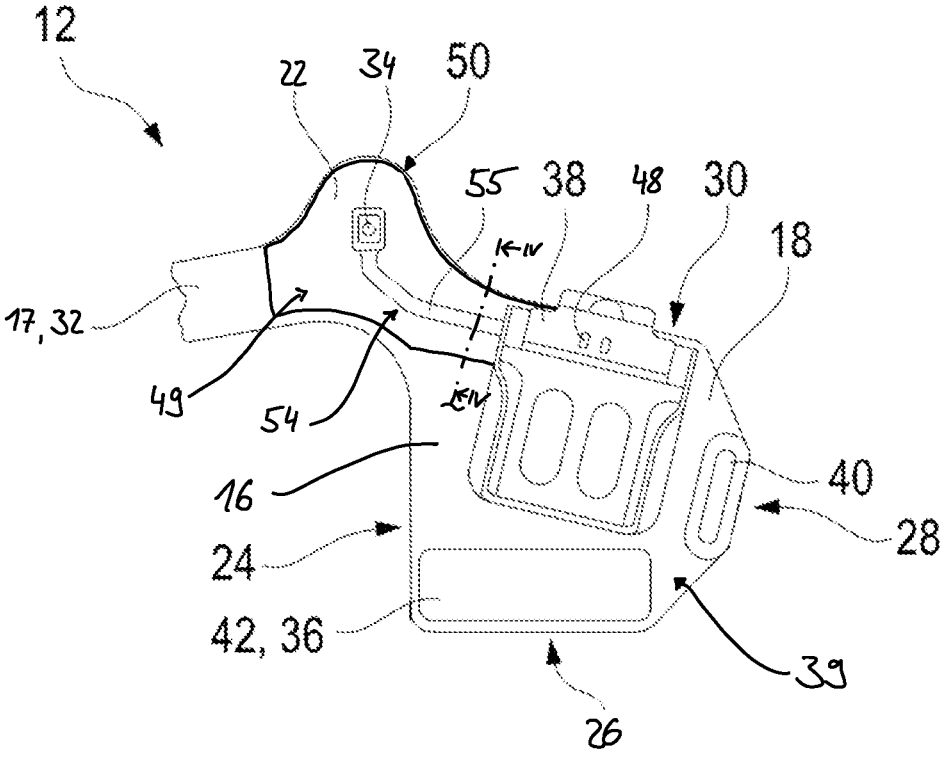
FIG. 2 shows an enlargement of the region of the base body of the glove according to FIG. 1 without a cover.

In FIG. 2, a part of the glove 12 is shown enlarged, more specifically the base body 16, however without the cover 20.

It can be clearly seen that an attachment means 36 and the first component 37 are attached to the base body 16, in particular the base layer 18, on its top side.

The attachment means 36 and the first component 37 are located on the dorsal section 39, i.e. the section of the base body 16 that rests on the dorsum of the user's hand in the worn state. In addition, the dorsal section 39 comprises a first opening 40.

In the shown embodiment, the first component 37 is a holder 38 for the electronic module 14.

In the first embodiment shown, the attachment means 36 is a piece of hook-and-loop-fastener strip 42 that is complementary to a hook-and-loop-fastener strip of the strap section 32. This means that the hook-and-loop-fastener strips fasten to each other when they come into contact with each other, thus forming a hook-and-loop fastening.

The first opening 40 is located on the side-of-the-hand edge 28 and is nearly slit-shaped. Moreover, the first opening 40 can be reinforced using an eyelet.

In the worn state, the strap section 32 is guided along the palm and runs through the opening 40. Then, the strap section 32 is guided along the palm once again and attached to the attachment means 36 coming across the thumb-side edge 24.

The holder 38 is provided on the finger-side edge 30 of the base layer 18 and attached to the top side of the base layer 18.

The holder 38 adjoins the finger-side edge 30 or projects over the finger-side edge 30. In particular, the holder 38 is located parallel to the finger-side edge 30.

Two contact elements 48 used for the contacting of the electronic module 14 are provided on the holder 38. The contact elements 48 project into a receiving space of the holder 38, in which the electronic module 14 can be inserted.

The electronic module 14 comprises correspondingly implemented mating contacts that contact the contact elements 48 electrically when the electronic module 14 is inserted in the holder 38.

It is also conceivable that the first component 37 comprises the electronic module 14 that is attached to the base body 16 permanently. In this case, the contact elements 48 constitute the contact elements and mating contacts of the electronic module 14.

The base body 16 comprises a trigger section 49 on its transition region from the thumb-side edge 24 to the finger-side edge 30, said trigger section 49 being designed, for example, as a tongue 50. The tongue 50 extends away from the wrist-side edge 26.

The trigger 34 is located on the tongue 50 at least partially, in particular completely. The tongue 50 and the trigger 34 rest in the worn state of the glove 12 on the radial side of the metacarpophalangeal joint of the index finger of the user's hand.

The trigger 34 is, for example, a mechanical push button attached to the top side of the trigger section 49.

The trigger 34 is connected electrically to the first component 37, in particular the contact elements 48 of the holder 38, by means of a signal line 54.

The signal line 54 thus runs in part between the base layer 18 and the first component 37, thus here the holder 38.

The length of the signal line 54 equals the distance between the trigger 34 and the contact elements 48. It is also conceivable that the signal line is designed longer, thus with excess length.

It is also conceivable that the trigger 34 has rounded corners on the opening for the signal line 54 so that the signal line does not rub on the sharp edges of the opening when subjected to tensile forces.

The signal line 54 comprises a flexible printed circuit board 55 and is designed as a flex PCB cable.

The trigger 34 and the signal line 54 are covered by a cover 20 that is not shown in FIG. 2. The cover 20 completely covers the trigger section 49. For example, the cover 20 extends at least from the trigger 34 on the tongue 50 to the first component 37 and connects to this.

For example, the cover 20 comprises a receiving space formed in it, in which the trigger 34 is located.

Figure 3:
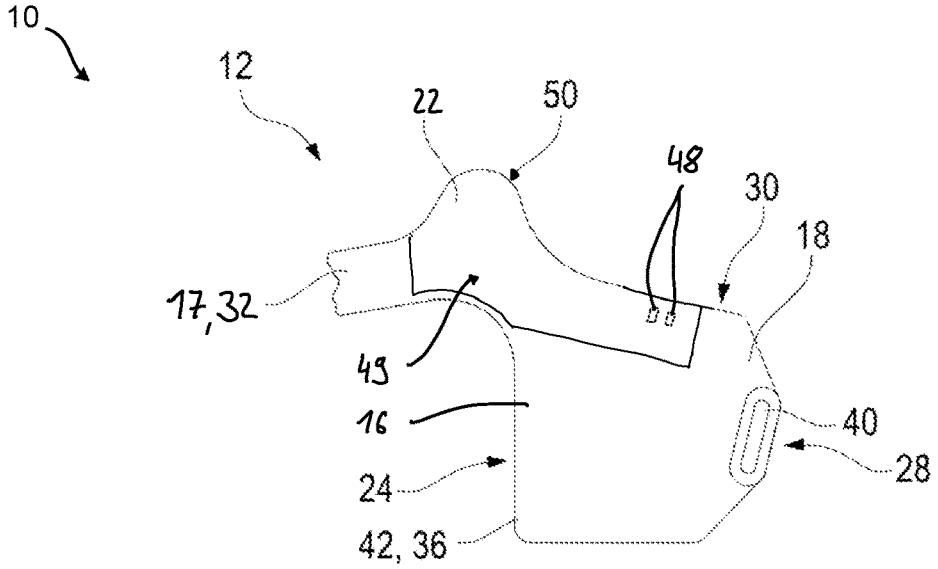
FIG. 3 shows an enlarged view of the base body of the glove according to FIG. 1 with protective layer applied.

In FIG. 3, the glove 12 is shown in the same view as in FIG. 2, however, without the cover 20, the first component 37 and the attachment means 36. The protective layer 22 can now be seen.

The protective layer 22 is made of a non-stretchable material, for example nylon. It can be a 210 dernier, tear-proof nylon.

The material of the protective layer 22 is at least less stretchable than the material of the base layer 18 and also less stretchable than the material of the cover 20.

The protective layer 22 is provided at least in the region of the signal line 54, i.e. the signal line 54 and the protective layer 22 overlap in a top view.

The signal line 54 runs on the protective layer 22, in particular completely on the protective layer 22.

The protective layer 22 extends in the shown embodiment along the entire length of the signal line 54, i.e. also in part in the region, in particular, under the first component 37.

The protective layer 22 can also be provided in the region of the trigger 34. For example, the trigger 34 is adhered to the protective layer 22.

In the shown embodiment, the protective layer 22 is provided in 70%, in particular 90% of the trigger section 49. For example, the protective layer 22 corresponds to the trigger section 49 and also extends in the region of the first component 37.

Figure 4:
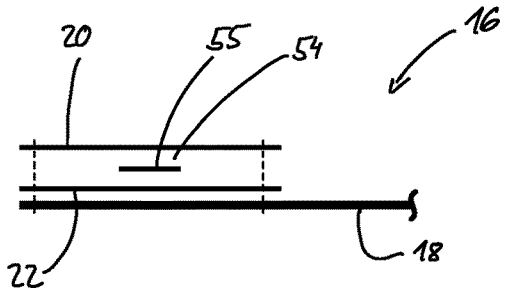
FIG. 4 shows a schematic sectional view through the glove along the line IV-IV of FIG. 2.

In FIG. 4, a section is shown through the glove 12 in the trigger section 49.

The base layer 18 is facing the user's hand in the worn state and forms the inner layer of the glove 12.

The protective layer 22 is located on or above the base layer 18, i.e. on the side of the base layer 18 facing away from the hand.

The protective layer 22 is attached to the base layer 18, for example by being fused with the base layer 18, in particular its entire surface. However, the protective layer 22 can be attached to the base layer also or in addition by means of sewing or adhesion.

The signal line 54 is provided on the base layer 18 as well as the trigger 34 and in part the first component 39, thus here the holder 38, which are not shown in FIG. 4.

The signal line 54 is also attached to the base layer 18. For example, the signal line 54 is attached to the protective layer 22 and thus to the base layer 18 when fusing the protective layer 22. It is also conceivable that the signal line 54 is adhered to the base layer 18.

In particular, the signal line 54 is not sown with the base layer 18 and/or the signal line 54, in particular the flexible printed circuit board, remains undamaged by sewing the cover 20 or the protective layer 22 to the base layer 18.

The protective layer 22 is thus located between the base layer 18 on the one side and the signal line 54, the trigger 34 and the first component 37 on the other side.

The cover 20 forms the top side of the glove in the trigger section 49 and covers the signal line 54 and the trigger 34 in the trigger section 49.

The signal line 54 and the trigger 34 are thus located between the cover 20 and the base layer 18.

The cover 20 is also attached to the base layer 18, for example by means of sewing. The seams are shown in FIG. 4 as dashed lines.

For example, the base layer 18, the protective layer 22 and the cover 20 are sown together with the same seam.

It is also conceivable that the signal line 54 is not connected in a fixed manner to the protective layer 22 or the base layer 18, but rather is moveable between the cover 20 and the protective layer 22 in its longitudinal direction.

By means of the protective layer 22 that is designed to be non-stretchable or at least less stretchable than the base layer 18 and the cover 20, stretching of the glove 12 is reliably prevented in the region of the signal line 54, even when subject to strong stresses, such as when taking off the glove 12. As a result, it prevents the signal line 54 from being subjected to tensile forces or the distance between the first component 37 and the trigger 34 from being increased. In this way, an extremely long service life of the signal line 54 and the connection between the signal line 54 and the trigger 34 is achieved.

The stress on the signal line 54 and on the connection between the signal line 54 and the trigger 34 is reduced further if the signal line 54 is designed with excess length.

Also moveability of the signal line 54 between the cover 20 and the protective layer 22 increases the service life.

Figure 5:
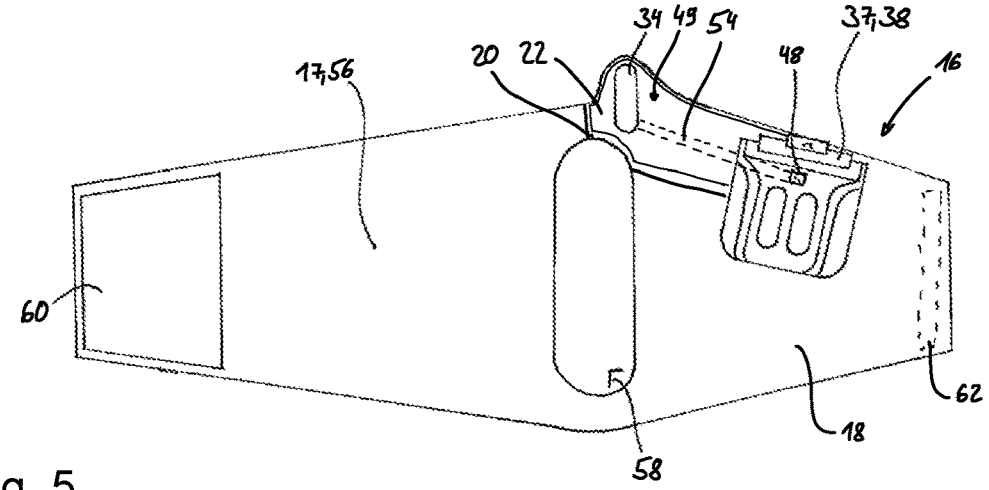
FIG. 5 shows a glove according to a second embodiment of the invention in top view in a position spread out on a table.

In FIG. 5, a second embodiment of a glove 12 according to the invention is shown that substantially corresponds to the first embodiment. Therefore, only the differences are discussed hereinafter and the same parts and parts with the same function are provided with the same reference signs.

In contrast to the first embodiment, the attachment section 17 is a palm section 56, which rests on the user's palm in the worn state.

The palm section is, for example, made of the same material as the base layer 18, and is designed in particular as a single piece with the base layer 18.

The thumb opening 58 is formed between the palm section 56 and the base body 16.

The palm section 56 comprises an attachment element 60, for example a hook-and-loop-fastener, on its edge facing away from the base body 16.

A complementary attachment element 62 is provided on the side-of-the-hand edge 28 of the base body 16.

By means of the attachment elements 60, 62, the glove 12 can be closed around the user's hand so that the palm section 56 rests on the palm of the user's hand and attaches the base body 16 to the user's hand.

The invention claimed is:

1. A glove, comprising:

a base body;

a trigger;

a first component; and a signal line, wherein the first component is attached to the base body, wherein the signal line connects the first component to the trigger electrically and comprises a flexible printed circuit board, wherein the base body comprises at least a base layer and a cover, wherein the cover covers at least the trigger, wherein the trigger is located between the cover and the base layer, and wherein a protective layer is provided at least in a region of the signal line, said protective layer being attached to the base layer and made of a material that is less stretchable than the material of the cover and the material of the base layer.

2. The glove according to claim 1, wherein the protective layer extends between the base layer on one side and the signal line, the first component and/or the trigger on another side.

3. The glove according to claim 1, wherein the protective layer extends along an entire length of the signal line including the trigger.

4. The glove according to claim 1, wherein the protective layer is attached to the base layer by means of sewing, fusing and/or adhesion; and/or the signal line is attached to the base layer by means of fusing and/or adhesion; and/or that the cover is attached to the base layer by means of sewing.

5. The glove according to claim 1, wherein the first component comprises a holder for an electronic module and/or an electronic module.

6. The glove according to claim 1, wherein the protective layer is made of a non-stretchable material, the base layer is made of a stretchable material, and/or the cover is made of a stretchable material.

7. The glove according to claim 6, wherein the non-stretchable material of the protective layer is nylon, the stretchable material of the base layer is neoprene, imitation leather, synthetic leather, microfibre material, mesh material and/or spacer fabrics, and/or the stretchable material of the cover is a plastic material.

8. The glove according to claim 1, wherein the cover extends from the trigger in a direction of the first component and the signal line is located between the cover and the base layer, wherein the cover connects to the first component.

9. The glove according to claim 1, wherein the base body comprises a dorsal section, on which the first component is located and/or a trigger section, on which the trigger is located.

10. The glove according to claim 9, wherein the trigger section is provided on a thumb-side edge of the dorsal section and/or the trigger rests in a worn state of the glove on a radial side of a metacarpophalangeal joint of an index finger of a user's hand.

11. The glove according to claim 10, wherein the glove has an attachment section designed to attach the base body to the user's hand.

12. The glove according to claim 11, wherein the attachment section is a palm section, made of a same material as the base layer, and/or is designed as a single piece with the base layer.

13. The glove according to claim 11, wherein the attachment section is a strap section, that extends from the trigger section and is attached detachably to the dorsal section of the base body.

14. The glove according to claim 1, wherein the glove has an attachment section designed to attach the base body to a user's hand.

15. A wearable device comprising the glove according to claim 1 and an electronic module that is inserted into a holder of the first component, wherein the electronic module has a camera, a code reader, and/or a display for displaying instructions to a user that are triggerable by actuating the trigger.

16. The wearable device according to claim 15, wherein the code reader is configured to read optical codes or RFID tags.

* * * * *